US007131302B2

(12) United States Patent
Waskiewicz et al.

(10) Patent No.: US 7,131,302 B2
(45) Date of Patent: Nov. 7, 2006

(54) KEYWAY PLUG FOR SAFE DEPOSIT LOCKS

(76) Inventors: James Richard Waskiewicz, 39169 Ross, Livonia, MI (US) 48154; Michael Frank Yonkus, 3845 Parker, Dearborn, MI (US) 48124

( * ) Notice: Subject to any disclaimer, the term of this patent is extended or adjusted under 35 U.S.C. 154(b) by 0 days.

(21) Appl. No.: 11/116,158

(22) Filed: Apr. 27, 2005

(65) Prior Publication Data

US 2005/0241352 A1 Nov. 3, 2005

Related U.S. Application Data

(60) Provisional application No. 60/565,980, filed on Apr. 28, 2004.

(51) Int. Cl.
*E05B 17/14* (2006.01)
*E05B 47/00* (2006.01)

(52) U.S. Cl. ..... 70/428; 70/276; 70/413

(58) Field of Classification Search ..... 70/424, 70/427, 428, 276, 413, 423, 425, 426, 455, 70/395, 400, 429, 430; 292/251.5
See application file for complete search history.

(56) References Cited

U.S. PATENT DOCUMENTS 1,431,381 A * 10/1922 Diesel et al. ..... 70/385
1,705,072 A * 3/1929 Hiram ..... 70/428
2,591,652 A * 4/1952 Ziegliss ..... 70/395
3,104,052 A * 9/1963 Nemsky ..... 232/4 R
3,276,233 A * 10/1966 Russell et al. ..... 70/382
3,338,078 A * 8/1967 Eberitch et al. ..... 70/428
3,408,842 A * 11/1968 Barnes et al. ..... 70/424
3,785,188 A * 1/1974 Drathschmidt ..... 70/276
4,300,674 A * 11/1981 Davet ..... 206/6.1
4,380,162 A * 4/1983 Woolfson ..... 70/276
6,119,496 A * 9/2000 Theriault ..... 70/406
6,272,891 B1 * 8/2001 Moen ..... 70/428
6,305,200 B1 * 10/2001 Moen ..... 70/428
6,397,649 B1 * 6/2002 Naber ..... 70/428

* cited by examiner

*Primary Examiner*—Lloyd A. Gall

(57) ABSTRACT

A keyway plug that discretely provides a device for preventing a person from unlocking a tumbler lock even if the correct key is used. The present invention includes a plug member that is sized to fit entirely within a keyhole and is effective to block a key from being completely inserted into the keyhole. The plug may be removed from the keyhole through use of an extraction tool having a magnet which attracts the plug and magnetically couples the plug to the extraction tool when the tool comes into contact with the plug.

10 Claims, 7 Drawing Sheets

KEYWAY PLUG FOR SAFE DEPOSIT LOCKS

CROSS-REFERENCE TO PROVISIONAL APPLICATION

This application claims the benefit of PPA Ser. No. 60/565,980, filed 2004 Apr. 28 by the present inventors.

FEDERALLY SPONSORED RESEARCH

Not applicable

SEQUENCE LISTING OR PROGRAM

Not applicable

FIELD OF INVENTION

This invention relates to a keyway plug, and an extractor specifically for a self serve safe deposit lock.

BACKGROUND OF INVENTION

This keyway plug and extractor relates to safe deposit locks like that of U.S. Pat. No. 1,431,381, and more specifically to self serve safe deposit locks. Over the past few years financial institutions have been eliminating the Safe Deposit Attendant position. One of the functions of the attendant was to insert the "guard key" in one side of the safe deposit lock and the customer would insert their "customer key" in the other side of the lock. Turning both keys would retract a bolt allowing the lock to open. With the introduction of self serve safe deposit locks the guard side of the lock has been eliminated. The only key required to open this lock is the "customer key". The customer can now access their safe deposit lock by themselves.

There are occasions when the financial institution has to deny access to the safe deposit lock. Some examples of these denials include; the possibility of someone obtaining the safe deposit key fraudulently, possibly a court order to seal the safe deposit lock, or possibly the rent not being paid, just to name a few.

The safe deposit keyway plug which we invented will solve each of these scenarios by preventing the safe deposit key from fully entering the lock. A keyway plug is inserted into the keyway of the lock and then can be removed with the plug extractor by an employee when the situation has been rectified.

There is a device shown in FIGS. 9 & 10 that has been used to block the keyway. This device can be hard to insert into the lock and can be broken by twisting the padlock thus breaking the device. It also is not aesthetically pleasing and creates unnecessary questions to the management.

OBJECTS AND ADVANTAGES

Accordingly, several objects and advantages of the safe deposit keyway plug described in our invention are:

(a) the ease of installing and removing the keyway plug;

(b) the visibility of a lock-out device is eliminated;

(c) the potential accidents that could occur by brushing against a device that protrudes from a lock is non existent;

(d) questions of why something is hanging out of a lock is eliminated;

(e) our invention cannot be forced from the lock because there is nothing to take hold of.

DRAWINGS

DRAWINGS—REFERENCE NUMERALS

| | | | |
|---|---|---|---|
| 10 | key plug | 12 | head of extractor |
| 14 | insertion device | 16 | keyway |
| 18 | extractor | 20 | safe deposit lock |
| 22 | customer post | 24 | cover |
| 26a–26g | wafer tumblers | 28 | locking bolt |

DETAILED DESCRIPTION OF THE DRAWINGS

The keyway plug 10, of the present invention provides a means of preventing the correct key from opening a safe deposit lock. The figures of the present disclosure show the present invention in operation with a safe deposit lock.

Figure 1:
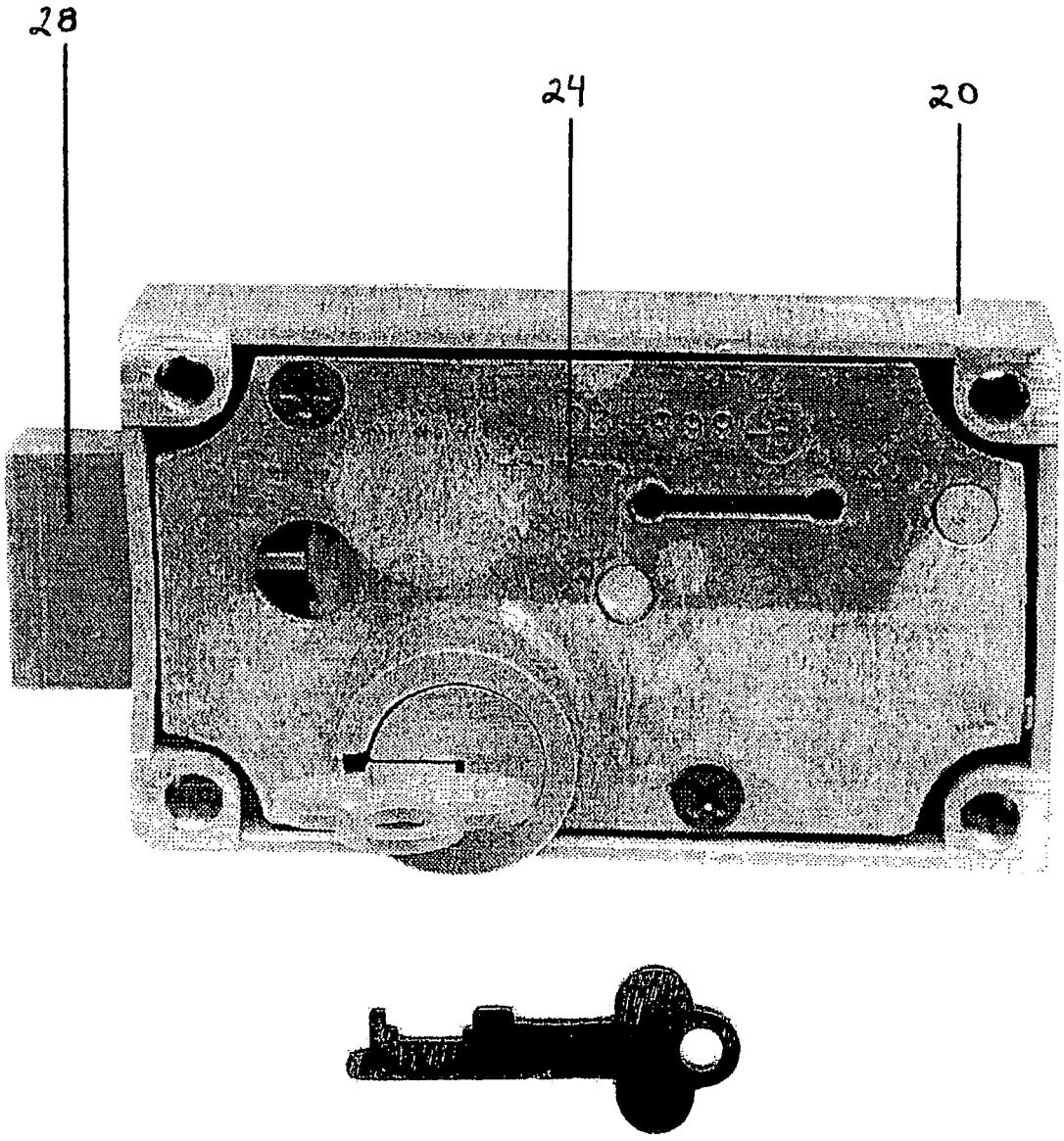
FIG. 1 shows a safe deposit lock with key inserted in the keyway and also a typical safe deposit key.
Figure 5:
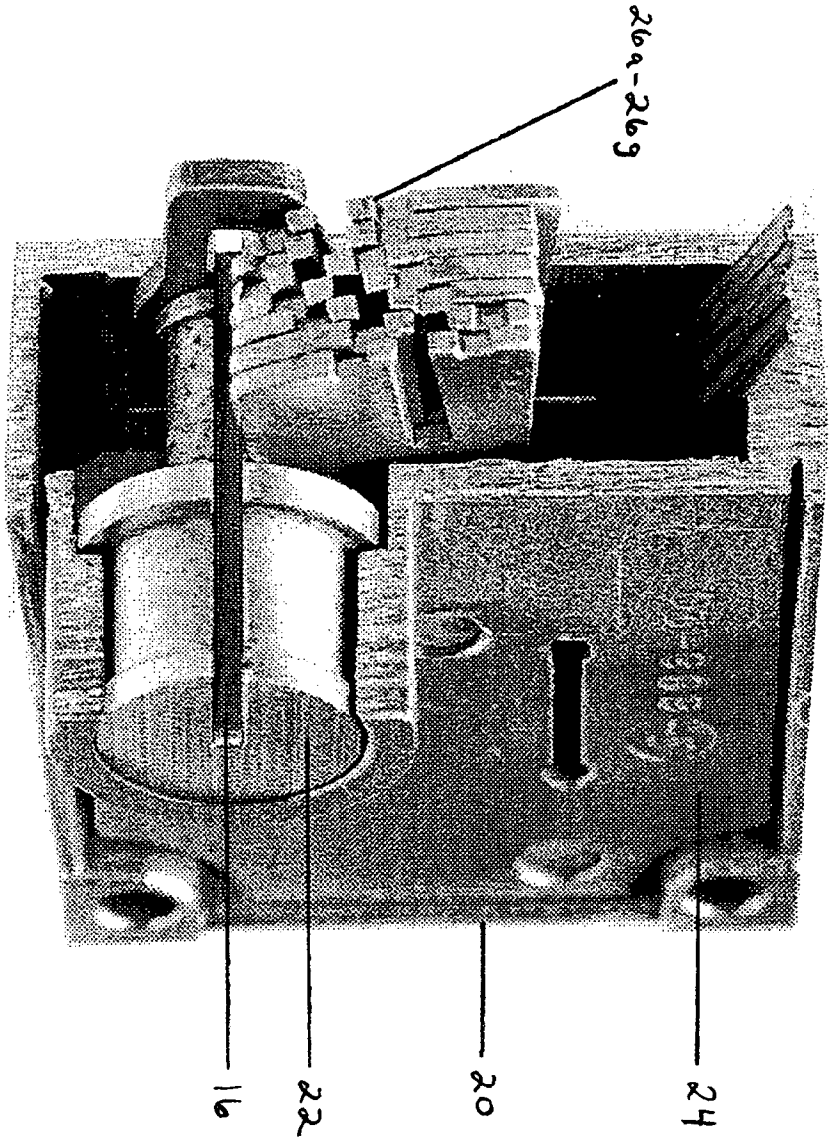
FIG. 5 shows an exploded side view of a safe deposit lock.

FIG. 1 illustrates a typical self serve safe deposit lock 20 with which the present invention will be used. The lock 20 includes a customer post 22 that rotates within the lock cover 24, a keyway 16, a series of wafer tumblers 26*a*–26*g* shown in FIG. 5 and a locking bolt 28. When the correct key (not shown) is inserted into the keyway 16, the wafer tumblers 26*a*–26*g* are aligned, permitting the customer post 22 to rotate and retract the locking bolt 28.

Figure 2:
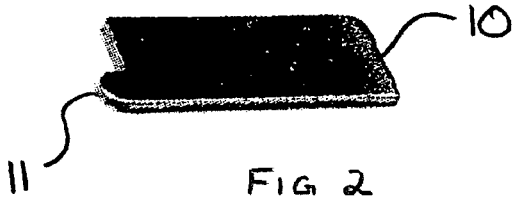
FIG. 2 shows a keyway plug.
Figure 3:
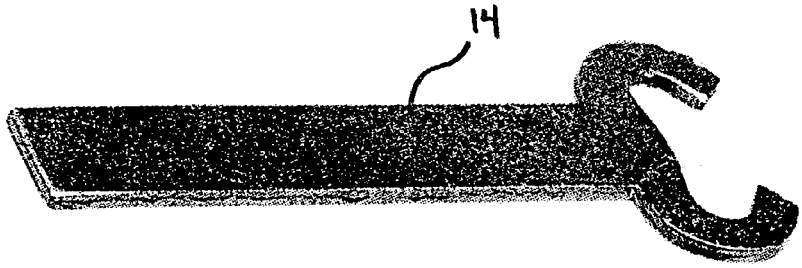
FIG. 3 shows a keyway plug insertion device.
Figure 7:
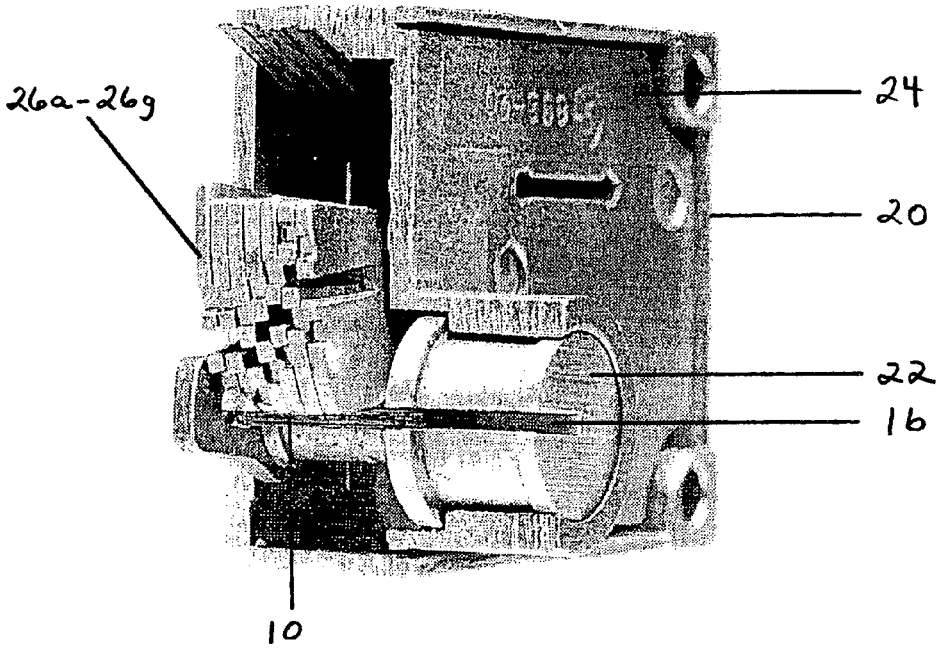
FIG. 7 shows an exploded side view of a safe deposit lock with a keyway plug inserted.
Figure 9:
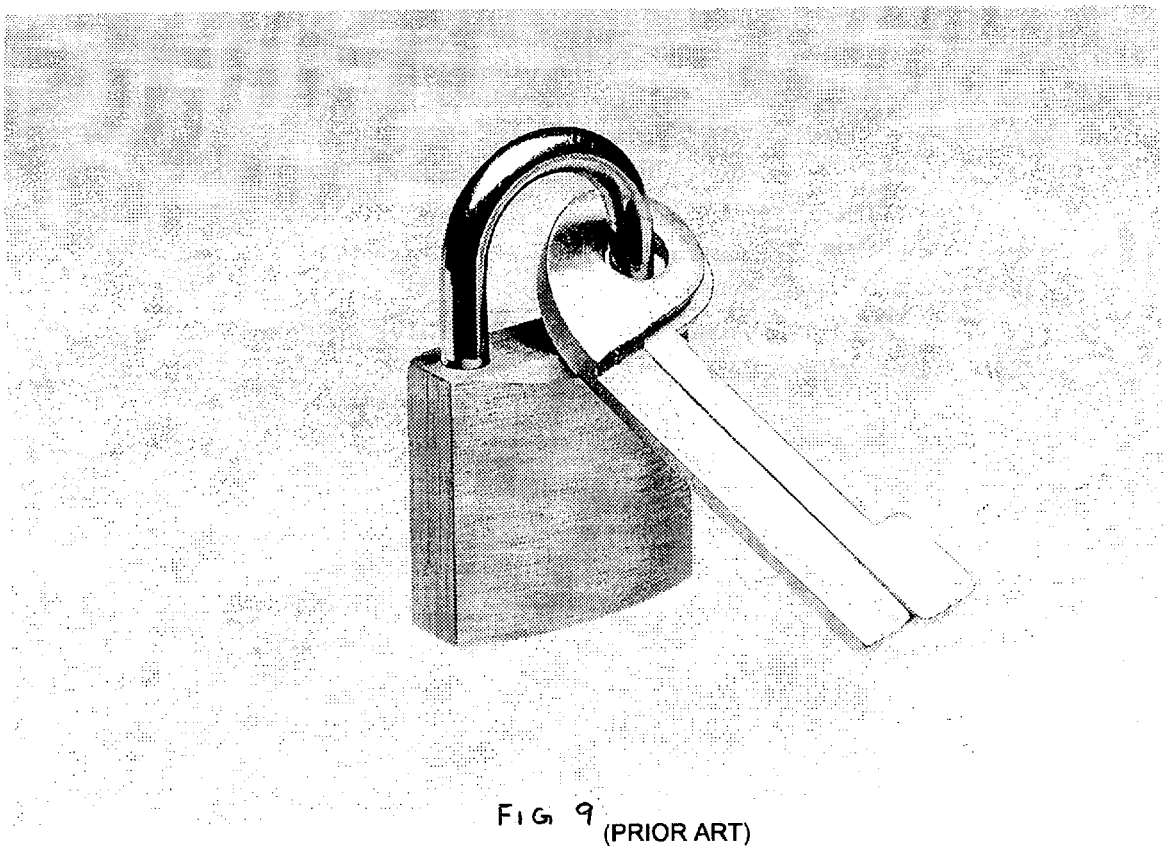
FIG 9 (PRIOR ART)
FIG. 9 shows a prior art device that can be used to plug a keyway.
Figure 10:
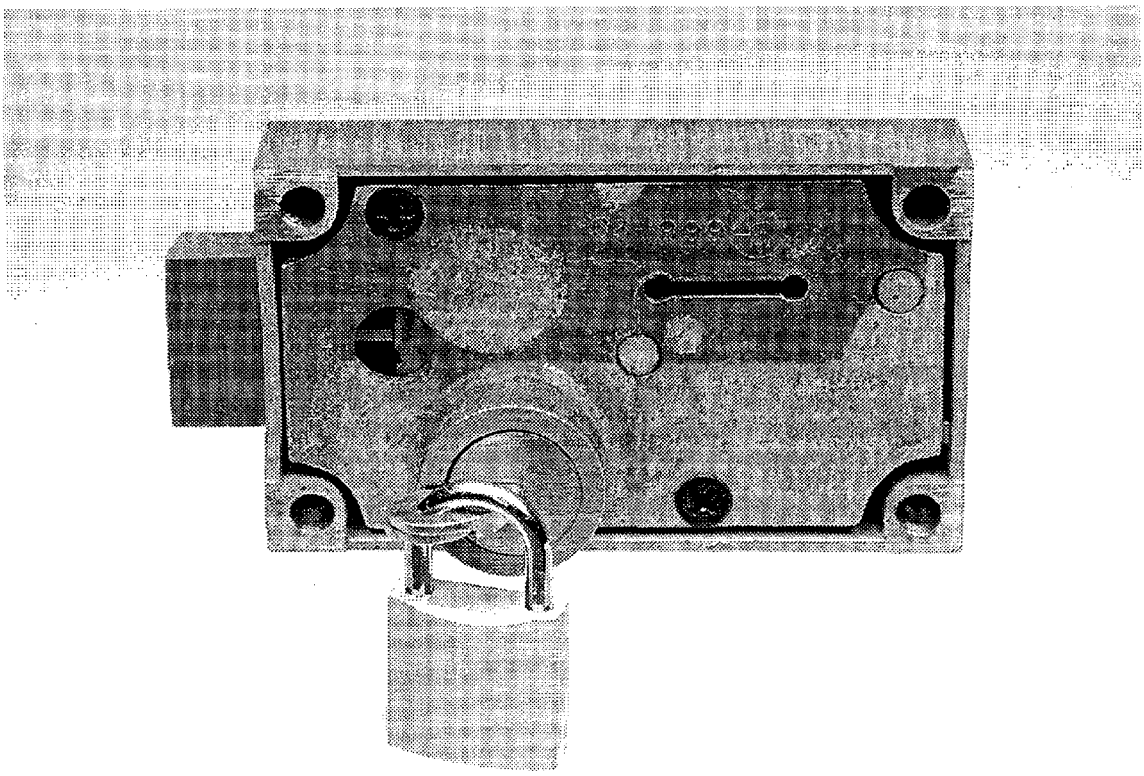
FIG 10 (PRIOR ART)
FIG. 10 shows a prior art plug device inserted in a safe deposit lock.

The keyway plug 10 of the present invention has at least two components, a plug 10 (FIG. 2) and an extractor 18 (FIG. 3). The purpose of the plug 10 is to prevent the key from completely being inserted into the keyway 16. The side view of the lock 20 and the plug 10 is shown in FIG. 7. The plug 10 is seated at the back of the keyway 16. Unlike the plug of the prior art FIG. 9 which we are aware of but could find no issued patent. Our plug 10 is hidden from casual inspection and does not protrude out of the keyway 16 like that of the prior art shown in FIG. 10.

Figure 4:
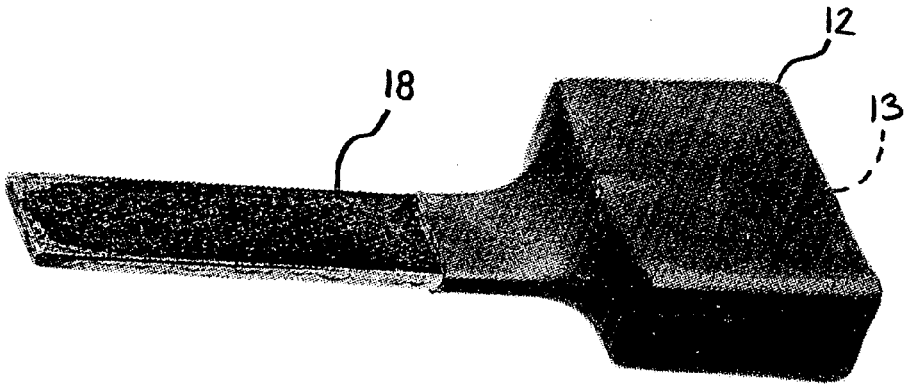
FIG. 4 shows a keyway plug extractor
Figure 8:
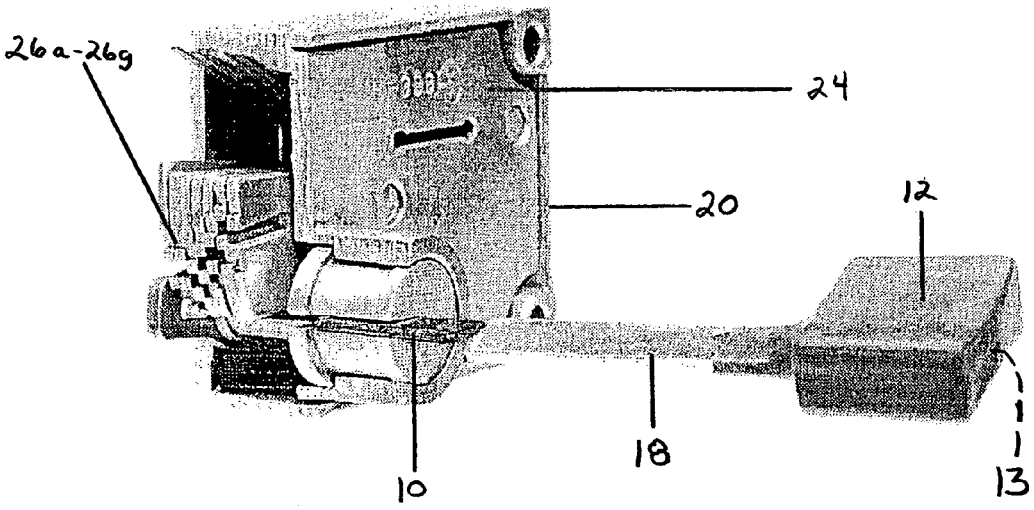
FIG. 8 shows an exploded side view of the keyway plug being removed from a safe deposit lock with the extractor.

The plug 10 is removed from the keyway 16 by an extractor 18 shown in FIG. 4 and illustrated in FIG. 8. The extractor 18 includes a magnet that is mounted inside of the head 12 which is used for grasping, like that of a regular key. When the extractor 18 is inserted into the keyway 16 and makes contact with the plug 10 it magnetizes the plug 10. The plug 10 being magnetized will follow the extractor 18 as it is pulled from the keyway 16.

Figure 6:
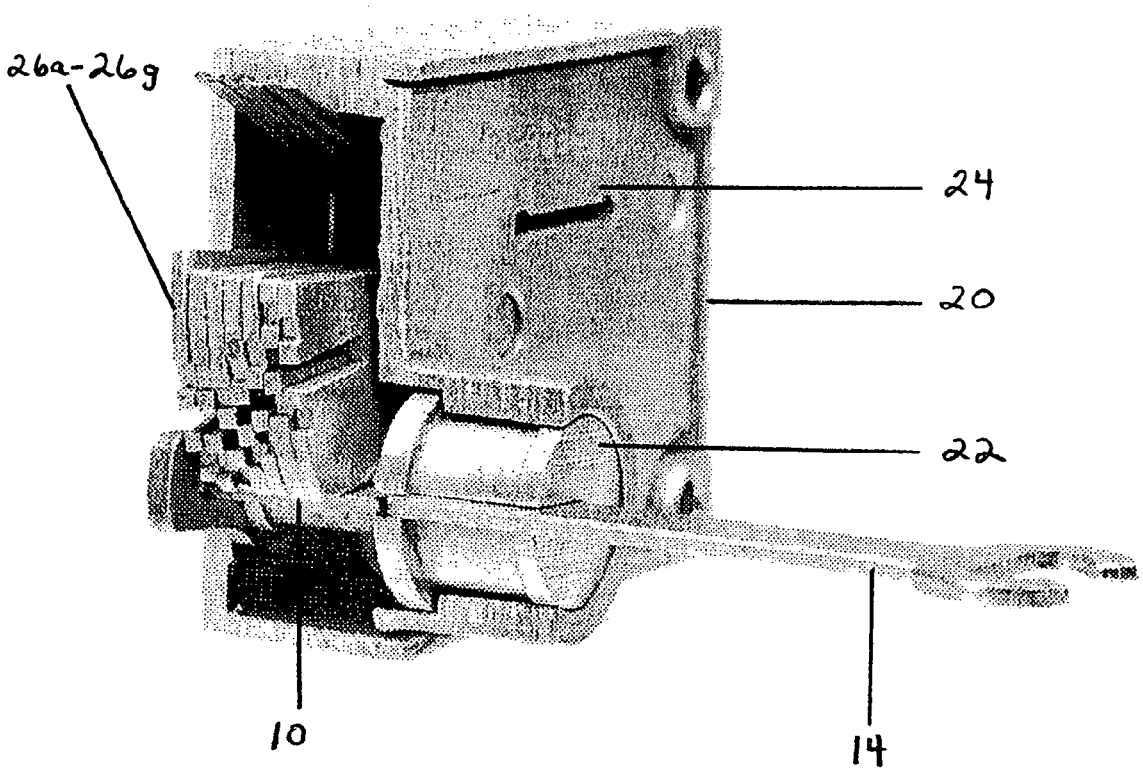
FIG. 6 shows a side view of the keyway plug and insertion device in a safe deposit lock.

The plug 10 is inserted into the keyway 16 by placing it in the entrance to the keyway 16 and pushing it into the keyway 16 until it stops. The plug 10 is initially placed and started into the keyway 16 manually. Once the plug 10 is inserted a small distance, to the point where a person's finger cannot push it in farther, a tool, such as a regular key FIG. 1 or a blank, must be used to push it in the rest of the way. Optionally, an inserter 14 shown in FIG. 3 and illustrated in FIG. 6, is provided with the plug 10 and the extractor 18. Preferably, the inserter 14 is similar to the extractor 18 with the exception of the magnet that is concealed in the head 12. The inserter 14 is removed from the keyway 16 after the plug 10 is fully inserted. Because the inserter 14 does not have a magnet attached, the plug 10 remains in the keyway 16.

Thus it has been shown and described a keyway plug which satisfies the objects set forth above.

We claim:

1. A keyway plug apparatus for use with a safe deposit lock having a keyway with an entrance into which a key is inserted, said keyway plug apparatus comprising:

a steel plug having a tip and is the approximate size of said keyway, said plug having a flat rear wall that spans the height of said plug and is parallel to said entrance when said plug is disposed within said keyway;

said plug adapted to fit into said keyway such that said plug occupies a latter part of said keyway, thus preventing easy removal of said plug;

an insertion device to push said plug to the back of said keyway ensuring the proper depth of said plug; and a steel extractor including a magnet, said extractor having a flat front end having a height approximately equal to a height of said keyway, said front end is parallel to said entrance and said rear wall when said extractor is disposed within said keyway;

whereby, when said extractor is inserted into said keyway facewise abutting contact is made between said front end and said rear wall, said magnet in said extractor magnetically couples said extractor to said plug and said plug can be removed by pulling said extractor out of said keyway.

2. The keyway plug apparatus of claim 1 wherein said steel extractor has an elongated portion which is inserted into said keyway, said elongated portion having a uniform profile.

3. The keyway plug apparatus of claim 1 wherein said plug has a height approximately equal to said height of said keyway.

4. A keyway plug apparatus for use with a safe deposit lock having a keyway with an entrance into which a key is inserted comprising:

a plug generally rectangular plate-shaped member which is sized to fit within and occupy only a rear portion of a safe deposit box keyway, said plug member having a height approximately equal to a height of said keyway and having a flat rear wall that spans said height of said plug; and an extraction device having an elongated portion which is magnetized and is sized to fit within said keyway, said extraction device having a flat front end that is parallel to said entrance and said rear wall when said extraction device is disposed within said keyway;

wherein said elongated portion magnetically couples said plug to said extraction device when placed in abutting engagement in said keyway.

5. The keyway plug apparatus of claim 4 wherein said extraction device includes a grasping head which includes a magnet, wherein said magnet is effective to cause a first portion of the device to be magnetized.

6. The keyway plug apparatus of claim 4 wherein said plug member is sized to fit entirely within said keyway.

7. The keyway plug of claim 4 further comprising:

an insertion device having an elongated portion that is not magnetized and is sized to fit within said keyway.

8. The keyway plug apparatus of claim 4 wherein said elongated portion has an outer periphery which is substantially uniform along a portion which is inserted into said keyway.

9. The keyway plug apparatus of claim 4 wherein said extraction device has a height approximately equal to said height of said keyway.

10. A method of discretely denying access to a safe deposit box keyway, said method comprising the steps of:

providing a generally rectangular plug having a height that is only slightly smaller than a height of said keyway, said plug having a flat rear wall that spans said height of said plug;

inserting said plug into said keyway, such that said rear wall is inserted last;

pushing said plug into said keyway until said plug no longer protrudes from said keyway;

selectively inserting an extraction device having a magnetic portion into said keyway;

magnetically coupling said extraction device and said plug; and removing said extraction device and said plug from said keyway.

* * * * *